US007022924B2

(12) United States Patent
Patton

(10) Patent No.: US 7,022,924 B2
(45) Date of Patent: Apr. 4, 2006

(54) WIRELESS ELECTRICAL CONTROL SYSTEM

(75) Inventor: James Patton, Humboldt, TN (US)

(73) Assignee: Black & Decker Inc., Newark, DE (US)

( * ) Notice: Subject to any disclaimer, the term of this patent is extended or adjusted under 35 U.S.C. 154(b) by 115 days.

(21) Appl. No.: 10/409,535

(22) Filed: Apr. 8, 2003

(65) Prior Publication Data

US 2003/0188441 A1 Oct. 9, 2003

Related U.S. Application Data

(60) Provisional application No. 60/370,960, filed on Apr. 9, 2002.

(51) Int. Cl.
*H01H 33/955* (2006.01)

(52) U.S. Cl. ..... 200/52 R; 200/61.58; 30/381; 340/557; 340/689; 400/88

(58) Field of Classification Search ..... 200/52 R, 200/61.01, 61.58 R; 30/381; 340/551, 556, 340/557, 569, 689, 539; 400/88, 489
See application file for complete search history.

(56) References Cited

U.S. PATENT DOCUMENTS

| | | | | |
|---|---|---|---|---|
| 4,370,909 | A * | 2/1983 | Jennings | 83/436.2 |
| 6,419,429 | B1 * | 7/2002 | Long et al. | 409/182 |
| 6,536,536 | B1 * | 3/2003 | Gass et al. | 173/2 |
| 6,588,112 | B1 * | 7/2003 | Zeiler et al. | 30/391 |
| 6,834,730 | B1 * | 12/2004 | Gass et al. | 173/2 |

* cited by examiner

*Primary Examiner*—K. Lee
(74) *Attorney, Agent, or Firm*—Suiter West Swantz pc llo

(57) ABSTRACT

The present invention is directed to a wireless electrical control system for power tool and specifically to a wireless control device for a router. The electrical control system may include a handle suitable for manipulating a router. A switch and a wireless transmitter are disposed in the handle. Communicatively coupled to the transmitter is a wireless receiver capable of receiving the transmissions from the transmitter in the handle. In alternative embodiments the wireless receiver is disposed in the router itself or the receiver is disposed in an outlet unit, which is capable of electrically coupling to the router's electrical cord and an electrical outlet. The wireless receiver of the present invention is capable of controlling the flow of electricity to the electrical system of the router so that the router is capable of being altered from the switch mounted on the handle, thus allowing users to change the power setting while retaining secure control of the router.

38 Claims, 6 Drawing Sheets

WIRELESS ELECTRICAL CONTROL SYSTEM

CROSS REFERENCE

The present application claims priority to U.S. Provisional Patent Ser. No. 60/370,960, entitled: Wireless Electrical Control System, filed on Apr. 9, 2002, which is hereby incorporated in its entirety.

FIELD OF THE INVENTION

The present invention generally relates to the field of power tools and particularly to a wireless electrical control system for a router.

BACKGROUND OF THE INVENTION

Power tools are increasingly more pervasive in everyday life. Users demand tools having specific functional characteristics based on planned utilization. Although some users have varying demands, consistently all purchasers want tools which aid in achieving high levels of craftsmanship and offer increased safety. Often manufactures balance user demands against manufacturing and design considerations to provide tools meeting the demands for the largest number of users.

Users achieve high levels of craftsmanship by employing tools which are easily controlled. A router is difficult to control, especially when attempting to turn the electricity on or off because most routers include an electrical switch mounted in an inconvenient location on the router housing. A housing mounted electrical switch necessitates a user to grasp the router with one hand while operating the switch with their other hand. In this switching procedure the user fails to have optimal control over the router and as a result accidents may occur because the user's grasp is not secure. A user failing to control the router may cause damage to the work piece and/or an uneven profile.

Safety is of prime concern when utilizing power tools. Most accidents occur when a user fails to properly control the power tool. For instance, a user may lack control over a router when turning the router on or off. Furthermore, in an emergency situation involving a router the user often must release at least one hand to turn off the electricity to the router motor. Safe operation of a router is important to prevent kick-back and potential injury.

Purchasers want tools capable of performing multiple tasks. For example, a purchaser may decide to select a router capable of performing regular shaping and plunging action. Routers may provide these multiple functionalities through the use of removable bases. Because a user may wish to switch between various bases, such as a standard base and a plunge base, it is more efficient and permits greater functionality to dispose the electrical switch on the router housing rather than wiring a switch adjacent to where the router is grasped. As a result of this demand for multitasking, a router's electrical switch is typically mounted to the router housing.

Therefore, it would be desirable to provide a wireless system for actuating a power tool's electrical system and in particular a router's electrical system in a safe and convenient manner.

SUMMARY OF THE INVENTION

Accordingly, the present invention is directed to a wireless electrical control system for power tools and specifically a router. In a first aspect of the present invention, a wireless electrical control system for a router includes a switch mounted to handle for manipulating a router during utilization. A wireless transmitter is coupled to the switch.

The wireless transmitter communicates with a wireless receiver included in the router housing. The receiver is capable of actuating the router's electrical system. In the present aspect the wireless electrical control system may further include an indicator mounted to the router. The indicator is capable of providing an indication of the status of the router's electrical system and/or whether the receiver is receiving signals from the transmitter.

In a second aspect of the present invention, a wireless electrical control system for a router includes a wireless transmitter, coupled to a switch mounted on a handle suitable for manipulating the router.

The wireless electrical control system of the present aspect further includes an outlet unit including a wireless receiver capable of receiving transmissions from the wireless transmitter. The outlet unit is capable of coupling to the router's electrical cord and to an electrical outlet. The wireless receiver in the present aspect is capable of actuating the router's electrical system, in as much as the wireless controller may either allow or inhibit the transfer of electricity to the router, and thus to the router's motor.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to preferred embodiments of the present invention, examples of which are illustrated in the accompanying drawings.

Referring generally now to FIGS. 1 through 6, exemplary embodiments of the present invention are shown. A wireless electrical control system, of the present invention offers increased ease of use and safety.

Figure 1:
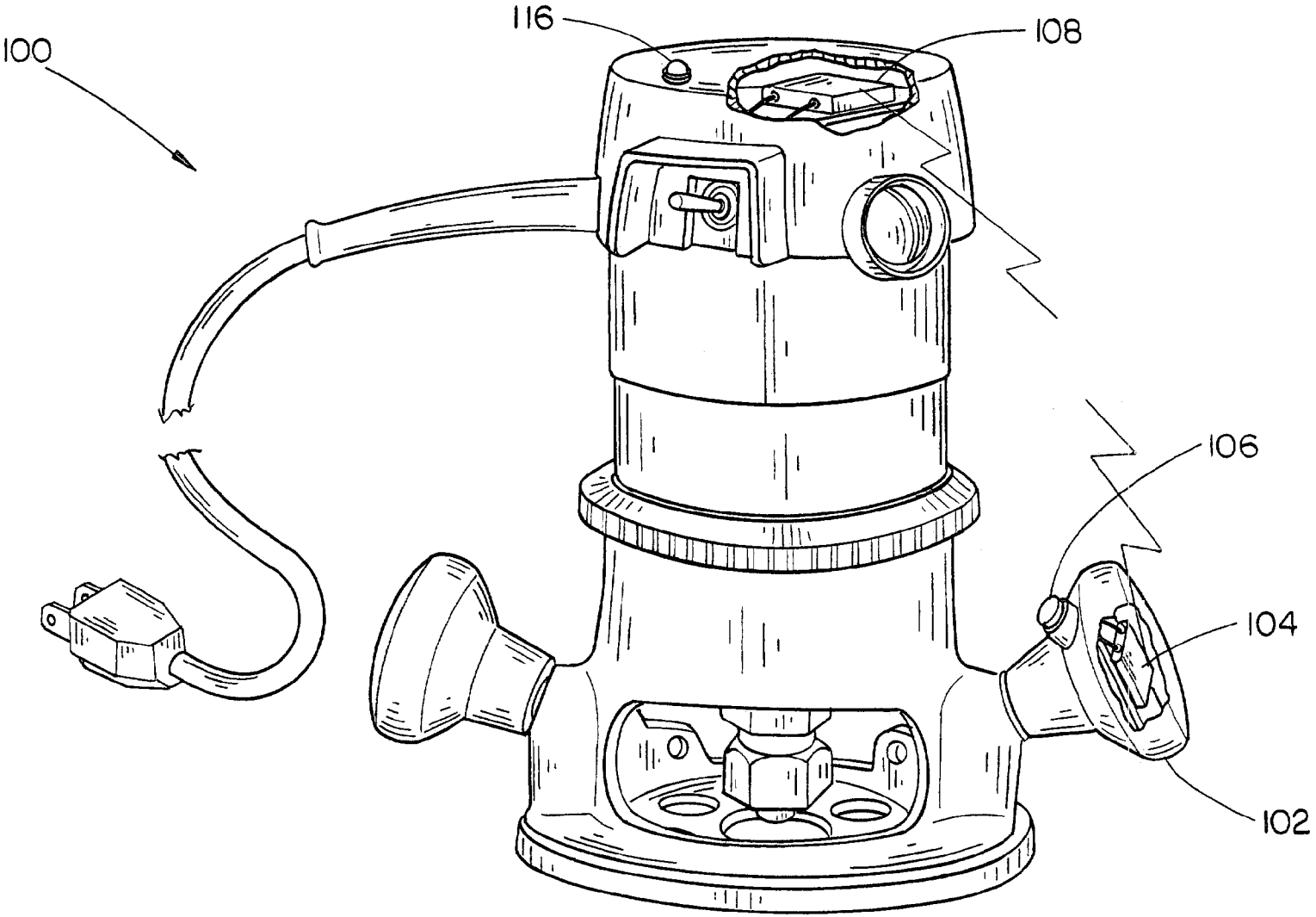
FIG. 1 is a side view illustration of an exemplary embodiment of the present invention wherein a wireless electrical control system is implemented with a wireless transmitter disposed in a router.

Referring to FIG. 1 a wireless electrical control system for a router 100 of the present invention is discussed. In the present aspect of the invention, the wireless electrical control system includes a handle 102 connected to the router. The handle 102 is held such that a user generally grasps the handle with the palm and the user's thumb is located inwardly towards the housing of the router. The handle 102 is suitable for manipulating the router, such as while the router is utilized for shaping a work piece. The handle may be configured in a variety of shapes, without departing from the spirit and scope of the present invention. For example in FIG. 3, the handle is shaped as a D-handle 304 for manipulating the router.

A wireless transmitter 104 is disposed at least partially within the handle 102. Preferably the transmitter 104 is disposed entirely within the handle 102 or partially within the handle 102 to permit implementing the wireless control system with multiple router bases. For example, a router including the wireless electrical control system 100, wherein the transmitter 104 is disposed in a handle 102, permits the user to switch between a standard base and a plunge base. In alternative implementations the transmitter is disposed partially within the base housing or partially exposed as contemplated by one of ordinary skill in the art so that the switch is accessible to a user grasping the handle.

A switch 106 is coupled to the wireless transmitter 104. The switch 106 is mounted to the handle 102 to allow efficient switching while permitting the user to retain firm control over the router. Locating the switch on the handle increase safety and reduces the overall chance of kick-back or inadvertent damage to the work piece.

The switch 106 is capable of actuating the transmitter 104 to send transmissions and/or cease transmission. In the present implementation, the switch toggles on and off by depressing and/or releasing the switch 102. Other suitable switches include a slide switch, a trigger switch or a switch designed for the comfort of the user or to conform generally to the handle. See generally FIG. 4 wherein a slide switch 406 is coupled to a wireless transmitter 404.

Moreover, the handle 102 is generally designed to protect the switch and facilitate use. The handle may protect the switch, by slightly extending outward from the surface of the handle. The switch 102 is further protected due to its generally inward position in relation to the router housing. The location of the switch on the handle in the current implementation allows a user to actuate the switch with a thumb.

In further implementations, user safety in increased by configuring the switch as a "dead man" control. A "dead man" control requires continual actuation of the switch in order for the tool to actuate or to remain actuated. A "dead man" control switch provides increased safety over a toggle because no positive action is required to shut off the tool. In other words a "dead man" control automatically turns off the electrical system in the event that the user fails to actuate the switch.

Communicatively coupled to the transmitter 104 is a wireless receiver 108. The wireless receiver 108 is capable of receiving transmissions from the transmitter 106. In the current embodiment, the wireless receiver 108 is disposed in the router. In additional embodiments the disposition of the wireless receiver 108 may vary as contemplated by one of ordinary skill in the art, such as by disposing the receiver only partially in the router to aid in receiving signals and the like.

The wireless receiver 108 may enable/disable the flow of electricity to the router motor. Furthermore, in embodiments a router implementing the present invention may include a main electrical switch 118 mounted to the router. In implementations such as this, the wireless electrical control system 100 of the present invention may operate in concert with the main switch such that both switches, the main switch 118 and the auxiliary, wireless electrical control system switch 106 mounted to the handle 104, must be turned on to activate the router's electrical system.

In further embodiments, the wireless electrical control system 100 includes an indicator, such as a light 116, a light emitting diode, a liquid crystal display and the like capable of indicating the status of the control system 100 and or indicate communicated signals for actuating the router's electrical system. In the present embodiment the indicator is mounted to the router.

In a second aspect of the present invention a wireless electrical control system for a router 200 includes an outlet unit 210. In the present embodiment the control system 200 may further have the advantage of allowing for retrofitting with previously existing routers.

The outlet unit 210 is capable of electrically coupling with a router's electrical cord 212 and an electrical outlet, such as a standard 60 Hz 120V outlet 214. In the present aspect the outlet unit 210 houses a wireless receiver 208 for communicating with a wireless transmitter 204. The wireless transmitter 204 is actuated by a switch 206, disposed in a handle 202 suitable for manipulating a router. In embodiments of the present invention the handle 206 is removable to allow implementation of the wireless control system in a retrofit, such as to switch the handle to a different base such a plunge base, as seen generally in FIG. 5. In regards to the present aspect, the function and design of the components are substantially similar to that which has been previously described.

In the present aspect, the wireless receiver 208 is capable of controlling the flow of electricity in as much as the receiver 208 may inhibit or allow electricity to flow to the router motor via the router's electrical cord 212.

It is to be understood that in embodiments where a router includes a main electrical switch 218, such as in the case of a retrofit actuation of the main switch 218, in addition to actuating the switch mounted to the handle 206 of the present invention, may be necessary to actuate the router's electrical system and subsequently the motor.

Additionally, the wireless electrical control system for a router 200 may further include an indicator such as a light 216, a light emitting diode, a liquid crystal display, and the like mounted to the outlet unit 210, the indicator is capable of indicating the status of the system 200.

Figure 2:
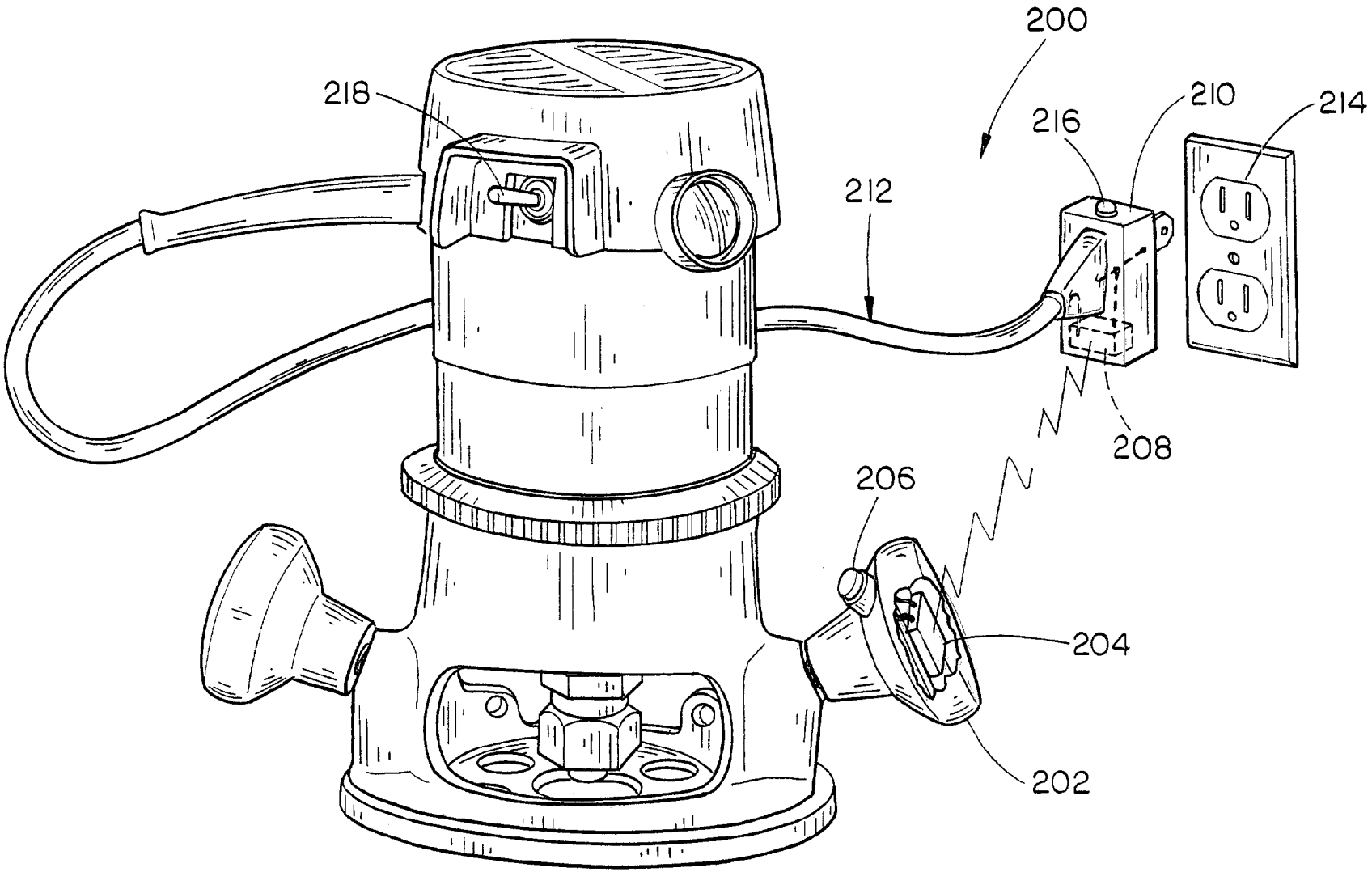
FIG. 2 is a side view illustration of an exemplary embodiment of the present invention wherein a wireless electrical control system includes a outlet unit suitable for coupling with a router's electrical cord and an electrical outlet.
Figure 3:
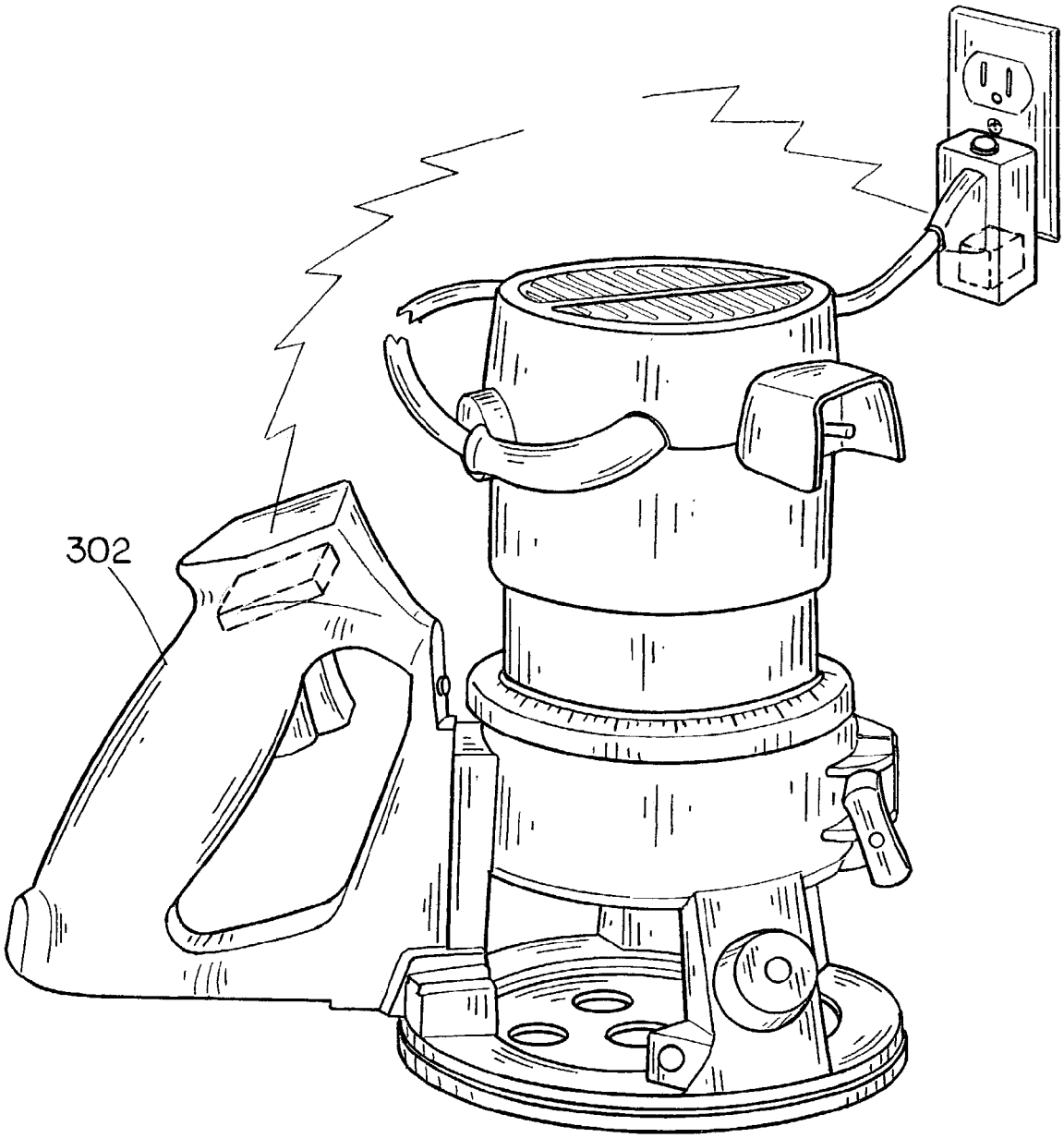
FIG. 3 is a side view illustration of an exemplary embodiment of the present invention wherein a wireless electrical control system includes a wireless transmitter and a trigger switch disposed in a D-handle.
Figure 4:
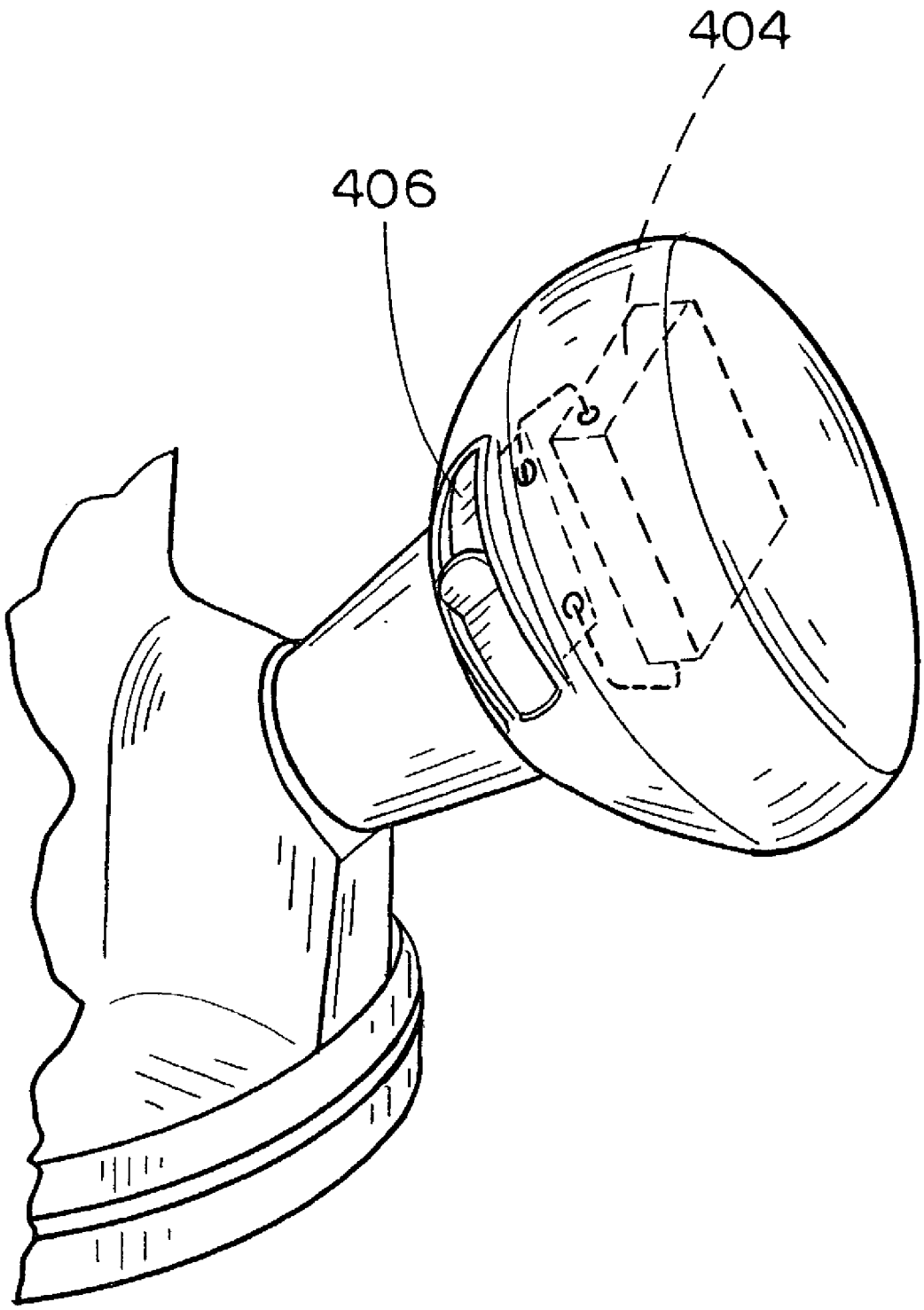
FIG. 4 is a side view illustration of an exemplary embodiment of the present invention wherein a slide switch coupled to a wireless transmitter is disposed in a handle suitable for inclusion in a wireless electrical control system for a router.
Figure 5:
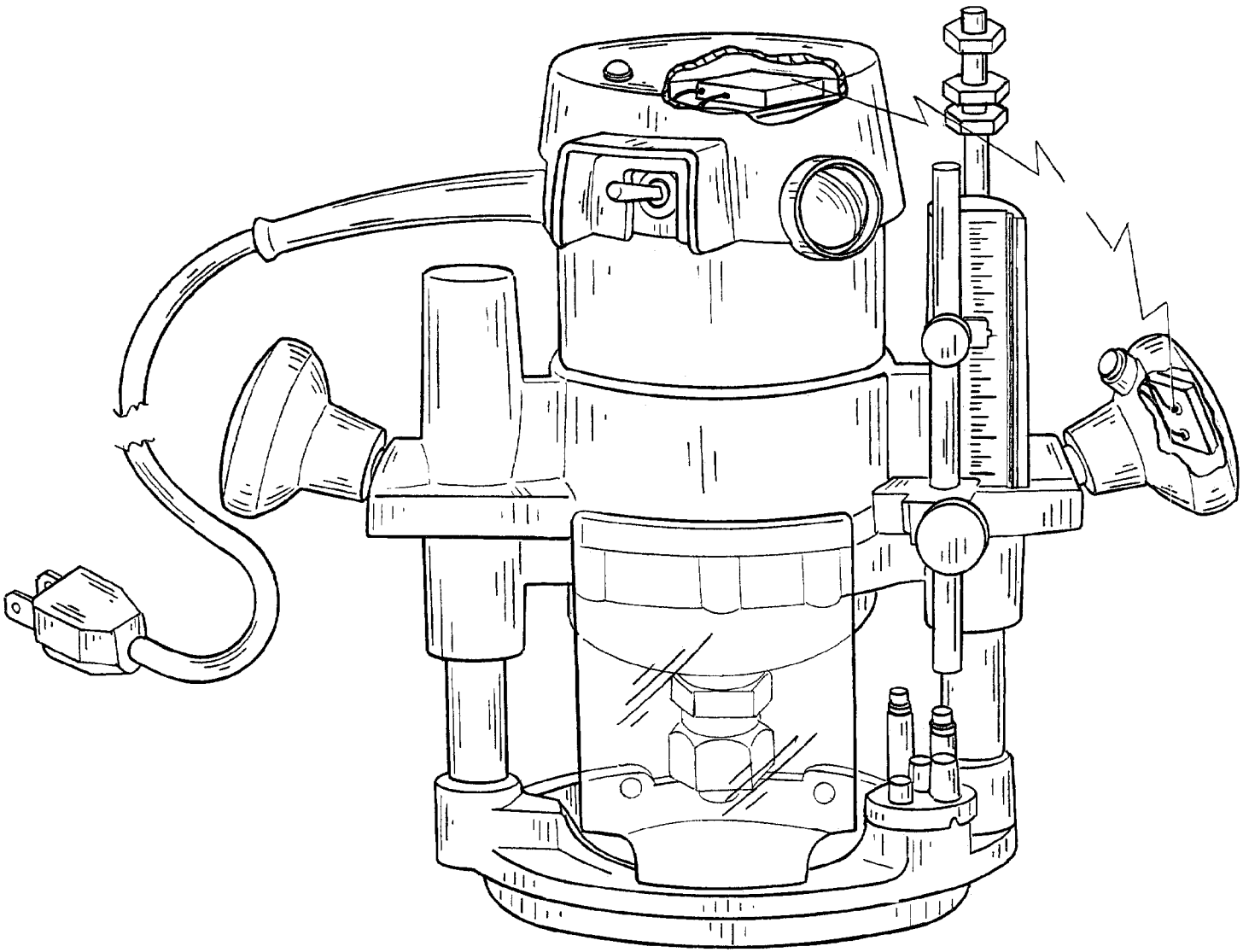
FIG. 5 is frontal view of an exemplary embodiment wherein a wireless electrical control system for a router is implemented with a router with a plunge base.

Preferably communication between a wireless receiver and a transmitter included in a wireless electrical control system is coded, such as the wireless electrical control systems 100 and 200 respectively of FIGS. 1 and 2.

Figure 6:
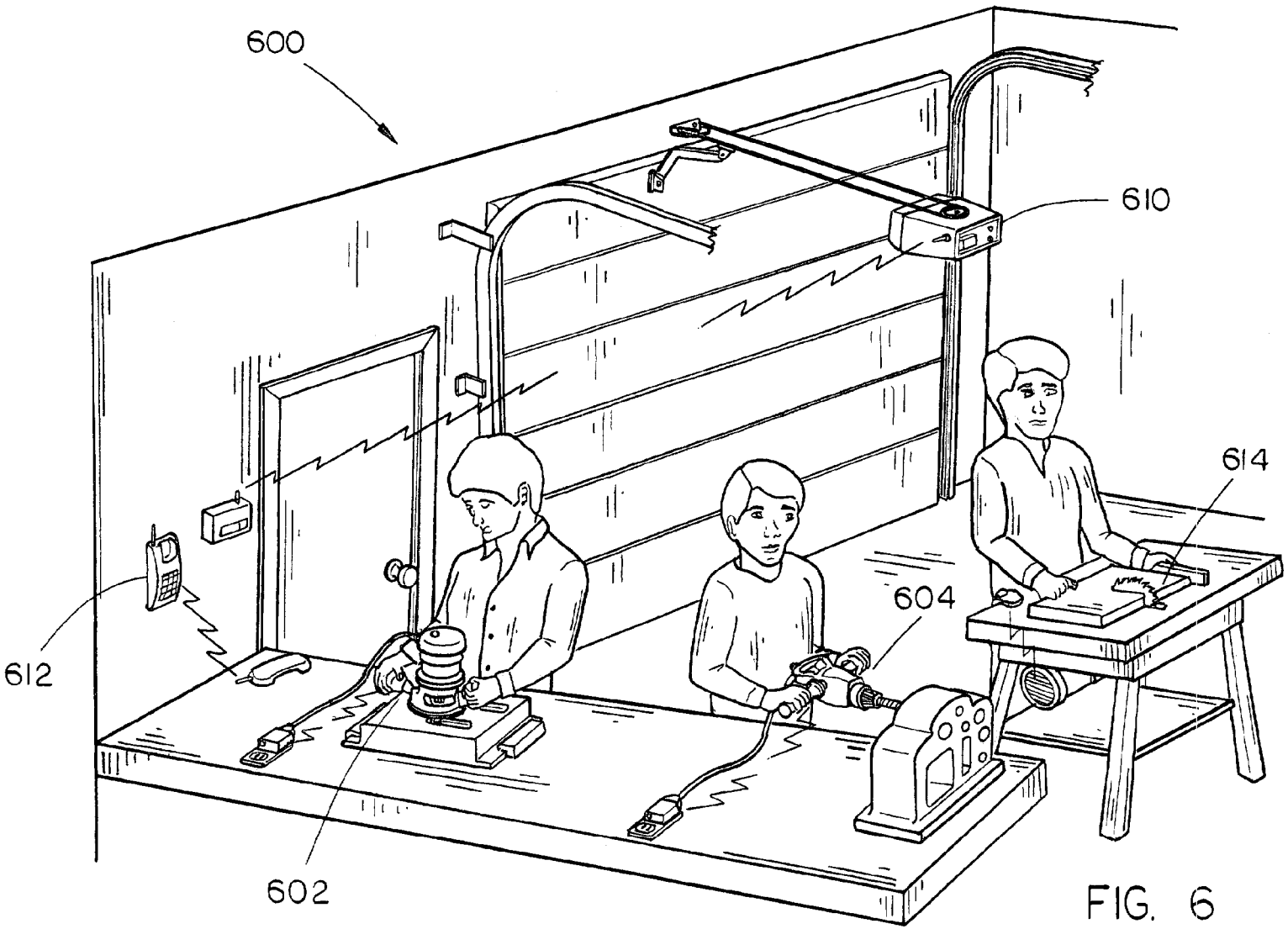
FIG. 6 is a perspective illustration of a electromagnetically noisy environment wherein a plurality of radio frequency electrical control systems are employed.

For example referring to FIG. 6, a wireless electrical control system implemented in a router 602 or a drill 604 communicates via coded wireless transmissions between respective transmitters and receivers. Coded communication prevents interference in communications due to environmental sources. A wireless electrical control device may operate in an area containing large amounts of electromagnetic energy such as in a woodshop or garage 600. Electromagnetic energy or noise is often generated when electrical devices are initially turned on or are poorly shielded, such as an old table saw 614. Other sources of noise include garage door openers 610, cordless phone 612 and other wireless devices. These latter sources of noise are particularly troublesome because these devices utilize radio frequency (RF) based communication. Beyond the hazard associated with accidental actuation, noise may overwhelm a wireless receiver, causing the electrical control system to fail or cause intermittent problems leading to user dissatisfaction.

Coded communication between a wireless transmitter and a wireless receiver included in a wireless electrical control system of the present invention further allows multiple power tools employing wireless electrical control systems to operate in close proximity. For example, a person utilizing a router 602 including a wireless electrical control system may be located adjacent to a user utilizing a drill 604 with a wireless electrical control system. Coded communication avoids cross interference and potentially inadvertent triggering of an adjacent device.

Coded communication between a wireless transmitter and wireless receiver included in the present invention preferably is spread spectrum technology. In additional embodiments, other forms of coded wireless radio signaling are capable of utilization including frequency modulation, amplitude modulation, pulse modulation, frequency hopping, time hopping, direct signaling and the like.

In the present aspect the wireless transmitter and receiver are capable of communicating via radio frequency (RF) signals, other wireless communication systems may be employed without departing from the scope and spirit of the present invention. Additional communication systems include infrared (IR), optical, microwave, magnetic and the like.

It is to be understood that the principles and advantages of the present invention may be modified by one of ordinary skill in the art so as to implement the present invention in other categories of power tools such as drills, saws, sanders, joiners, saber saws and the like hand power tools.

It is believed that the wireless electrical control system of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A wireless electrical control system for a router, comprising:

a handle connected to the router, suitable for manipulating the router;

a wireless transmitter disposed at least partially in said handle;

a switch coupled to said wireless transmitter, said switch is mounted to said handle; and a wireless receiver capable of receiving transmission from said wireless transmitter, said receiver is disposed in the router;

wherein said wireless receiver is capable of controlling the router's electrical system.

2. The wireless electrical control system for a router, of claim 1, further comprising an indicator capable of providing indicating the status of the router's electrical system, said indicator being mounted to the router.

3. The wireless electrical control system for a router, of claim 1, wherein the wireless transmitter and the wireless receiver are capable of implementing coded communication.

4. The wireless electrical control system for a router of claim 3, wherein coded communication is one of spread spectrum, frequency modulation, amplitude modulation, pulse modulation, frequency hopping, time hopping and direct signaling.

5. The wireless electrical control system for a router of claim 1, wherein the switch is mounted generally inwardly towards the router.

6. The wireless electrical control system for a router of claim 5, wherein the switch is shaped substantially to the contour of the handle surrounding the switch.

7. The wireless electrical control system for a router of claim 1, wherein the switch requires constant user actuation for the router's electrical system to activate.

8. The wireless electrical control system for a router of claim 1, wherein the handle is capable of protecting the switch.

9. A wireless electrical control system for a router, comprising:

a removable handle connected to the router, said removable handle is suitable for manipulating the router during utilization;

a wireless transmitter disposed in said removable handle;

an auxiliary switch coupled to said wireless transmitter, said auxiliary switch is mounted to said handle inwardly towards the router; and a wireless receiver capable of wirelessly receiving transmission from said wireless transmitter, said wireless receiver is disposed in the router;

a main switch capable of actuating the electrical system of the router;

wherein said wireless receiver is capable of controlling the router's motor when the main switch is actuated.

10. The wireless electrical control system for a router, of claim 9, further comprising an indicator capable of providing an indication of the status of the router's motor, said indicator being mounted to the router.

11. The wireless electrical control system for a router, of claim 9, wherein the wireless transmitter and the wireless receiver are capable of implementing coded communication.

12. The wireless electrical control system for a router of claim 11, wherein coded communication is one of spread spectrum, frequency modulation, amplitude modulation, pulse modulation, frequency hopping, time hopping and direct signaling.

13. The wireless electrical control system for a router, of claim 9, wherein the auxiliary switch is mounted generally inwardly towards the router.

14. The wireless electrical control system for a router, of claim 9, wherein the auxiliary switch is shaped substantially to the contour of the portion of the removable handle surrounding the auxiliary switch.

15. The wireless electrical control system for a router, of claim 9, wherein the auxiliary switch requires constant actuation for the router motor to activate.

16. The wireless electrical control system for a router, of claim 9, wherein the removable handle is capable of protecting the auxiliary switch.

17. A wireless electrical control system for a router, comprising:

a handle suitable for manipulating a router, said handle is capable of connecting to the router;

a wireless transmitter disposed at least partially in said handle;

a switch coupled to said wireless transmitter, wherein said switch is mounted to said handle;

an outlet unit capable of electrically coupling to an electrical outlet and the router's electrical cord; and a wireless receiver communicatively coupled to said wireless transmitter disposed in the outlet unit;

wherein said wireless receiver is capable of controlling electricity entering the router's electrical system.

18. The wireless electrical control system for a router of claim 17, further comprising an indicator capable of providing an indication of the status of the router's electrical system, said indicator being mounted to the outlet unit.

19. The wireless electrical control system for a router of claim 17, wherein the wireless transmitter and the wireless receiver are capable of implementing coded communication.

20. The wireless electrical control system for a router of claim 19, wherein coded communication is one of spread spectrum, frequency modulation, amplitude modulation, pulse modulation, frequency hopping, time hopping and direct signaling.

21. The wireless electrical control system for a router of claim 17, wherein the switch is mounted inwardly towards the router.

22. The wireless electrical control system for a router of claim 21, wherein the switch is shaped substantially to the contour of the portion of the handle surrounding the switch.

23. The wireless electrical control system for a router of claim 17, wherein the switch requires constant actuation for the router's electrical system to activate.

24. The wireless electrical control system for a router of claim 17, wherein the handle is capable of protecting the switch.

25. The wireless electrical control system for a router of claim 17, wherein both a main switch on the router and the switch included in the wireless electrical control system are necessary to turn on the router.

26. A wireless electrical control system for a router, comprising:

a handle suitable for manipulating a router, suitable for removably connecting to the router;

a wireless transmitter disposed at least partially in said handle;

a switch coupled to said wireless transmitter, wherein said switch is mounted to said handle;

an outlet unit capable of electrically coupling to an electrical outlet and the router's electrical cord; and a wireless receiver communicatively coupled to said wireless transmitter, said wireless receiver is disposed in the outlet unit;

wherein said wireless receiver is capable of controlling electricity entering the router's electrical system.

27. The wireless electrical control system for a router of claim 26, further comprising an indicator capable of providing an indication of the status of the electrical system, said indicator being mounted to the outlet unit.

28. The wireless electrical control system for a router of claim 26, wherein the wireless transmitter and the wireless receiver are capable of implementing coded communication.

29. The wireless electrical control system for a router of claim 28, wherein coded communication is one of spread spectrum, frequency modulation, amplitude modulation, pulse modulation, frequency hopping, time hopping and direct signaling.

30. The wireless electrical control system for a router of claim 26, wherein the switch is mounted generally inwardly towards the router.

31. The wireless electrical control system for a router of claim 30, the switch is shaped substantially to the contour of the portion of the handle surrounding the switch.

32. The wireless electrical control system for a router of claim 26, wherein the switch requires constant actuation for the router's electrical system to activate.

33. The wireless electrical control system for a router of claim 26, wherein the handle is capable of protecting the switch.

34. A wireless electrical control system for a router, comprising:

a means for manipulating the router, said manipulating means is suitable for connecting to the router;

a means for wirelessly transmitting signals at least partially disposed in said manipulating means;

a means for switching the electrical system of the router coupled to said transmitting means, said switching means is mounted to said manipulating means; and a means for receiving wireless transmissions from said transmitting means, said wireless receiving means disposed in the router;

wherein said wireless receiving means is capable of controlling the router's electrical system.

35. The wireless electrical control system for a router of claim 34, further comprising a means for indicating the status of the electrical system, said indicating means being mounted to the router.

36. The wireless electrical control system for a router of claim 34, wherein the wireless transmitting means and the wireless receiving means are capable of implementing coded communication.

37. The wireless electrical control system for a router of claim 36, wherein coded communication is one of spread spectrum, frequency modulation, amplitude modulation, pulse modulation, frequency hopping, time hopping and direct signaling.

38. The wireless electrical control system for a router of claim 34, wherein the switching means requires constant actuation for the router's electrical system to activate.

* * * * *